US007677212B2

(12) United States Patent
Stretch

(10) Patent No.: US 7,677,212 B2
(45) Date of Patent: Mar. 16, 2010

(54) ADDED MOTION HYDRAULIC CIRCUIT WITH PROPORTIONAL VALVE

(75) Inventor: Dale A. Stretch, Novi, MI (US)

(73) Assignee: Eaton Corporation, Cleveland, OH (US)

( * ) Notice: Subject to any disclaimer, the term of this patent is extended or adjusted under 35 U.S.C. 154(b) by 199 days.

(21) Appl. No.: 11/758,733

(22) Filed: Jun. 6, 2007

(65) Prior Publication Data

US 2008/0041329 A1 Feb. 21, 2008

Related U.S. Application Data

(60) Provisional application No. 60/817,770, filed on Jun. 30, 2006.

(51) Int. Cl.
*F01L 9/02* (2006.01)

(52) U.S. Cl. ..... 123/90.12; 123/90.15

(58) Field of Classification Search ..... 123/90.12, 123/90.13, 90.15
See application file for complete search history.

(56) References Cited

U.S. PATENT DOCUMENTS

| | | | | |
|---|---|---|---|---|
| 3,140,698 | A | 7/1964 | Voorhies | |
| 3,938,483 | A | 2/1976 | Firey | |
| 4,009,694 | A | 3/1977 | Firey | |
| 4,373,477 | A | 2/1983 | Buente et al. | |
| 4,671,221 | A | 6/1987 | Geringer et al. | |
| 4,796,576 | A | 1/1989 | Matsuura et al. | |
| 4,862,844 | A | 9/1989 | Wakeman et al. | |
| 4,972,761 | A | 11/1990 | Thomsen et al. | |
| 5,251,587 | A | 10/1993 | Mori et al. | |
| 5,460,129 | A | 10/1995 | Miller et al. | |
| 5,640,934 | A | 6/1997 | Mori et al. | |
| 5,680,841 | A | 10/1997 | Hu | |
| 5,685,264 | A | 11/1997 | Allen et al. | |
| 6,006,706 | A | 12/1999 | Kanzaki | |
| 6,223,846 | B1 * | 5/2001 | Schechter | 180/165 |
| 6,321,706 | B1 | 11/2001 | Wing | |
| 6,457,487 | B1 | 10/2002 | Stephenson et al. | |
| 6,477,997 | B1 | 11/2002 | Wakeman | |
| 6,655,349 | B1 | 12/2003 | Cavanagh | |
| 6,736,092 | B2 * | 5/2004 | Borean et al. | 123/90.12 |

(Continued)

FOREIGN PATENT DOCUMENTS

FR 2287583 5/1976

(Continued)

OTHER PUBLICATIONS

Office Action dated Apr. 29, 2009 for U.S. Appl. No. 11/758,757.

(Continued)

*Primary Examiner*—Zelalem Eshete
(74) *Attorney, Agent, or Firm*—Honigman Miller Schwartz and Cohn LLP

(57) ABSTRACT

A hydraulic circuit comprises a temperature sensor, an added motion valve system, and a valve. The temperature sensor detects operating temperature of fluid in the hydraulic circuit. The added motion valve system includes a valve body having an actuator fluid volume. The valve adjusts flow rate quantity of fluid to the actuator fluid volume as a function of the operating temperature of the fluid. A method for controlling the hydraulic circuit is also disclosed.

11 Claims, 3 Drawing Sheets

U.S. PATENT DOCUMENTS

| | | | | |
|---|---|---|---|---|
| 2002/0017256 | A1 | 2/2002 | Shiraishi et al. | |
| 2002/0066428 | A1 | 6/2002 | Kammerdiener et al. | |
| 2003/0213442 | A1* | 11/2003 | Cornell et al. | 123/90.12 |
| 2003/0213444 | A1 | 11/2003 | Cornell et al. | |
| 2004/0055564 | A1 | 3/2004 | Crowell et al. | |
| 2005/0087716 | A1 | 4/2005 | Udd | |
| 2005/0205019 | A1 | 9/2005 | Burk et al. | |
| 2005/0205065 | A1 | 9/2005 | Rembold et al. | |

FOREIGN PATENT DOCUMENTS

| | | |
|---|---|---|
| NL | 6400029 | 7/1964 |

OTHER PUBLICATIONS

Office Action dated May 25, 2007 for U.S. Appl. No. 11/518,834.
Office Action dated Sep. 19, 2007 for U.S. Appl. No. 11/518,834.
Office Action dated Oct. 31, 2007 for U.S. Appl. No. 11/528,995.
Office Action dated May 19, 2008 for U.S. Appl. No. 11/528,995.
Office Action dated Oct. 24, 2008 for U.S. Appl. No. 11/528,995.

* cited by examiner

ADDED MOTION HYDRAULIC CIRCUIT WITH PROPORTIONAL VALVE

RELATED APPLICATION

This disclosure claims the benefit of U.S. Provisional Patent Application Ser. No. 60/817,770 filed Jun. 30, 2006.

FIELD OF THE DISCLOSURE

The present disclosure relates generally to a system that provides a delayed closing movement for an engine valve of an internal combustion engine, including a system that provides controlled engine valve seating and controlled added motion closing movement for a valve over a wide range of fluid temperatures/viscosities.

BACKGROUND

It is known in the art that a cam system, which may include, for example, a cam shaft and rocker arm, can be employed to open and close a valve of an internal combustion (IC) engine. An example of a standard cam profile engine valve opening/closing curve 300*a* is generally shown in FIG. 3.

The timing of engine valve closure during an IC engine's induction stroke may be varied to, among other things, optimize the performance of the engine. Variable valve timing in the closing of the engine valve can be accomplished by, for example, employing a hydraulic force actuator that counteracts the closing force of the valve spring. As generally illustrated in FIG. 3, the delayed closing movement of the engine valve (generally represented in the Figure by 301) is often referred to as an "added motion."

Although current added motion systems can provide a desired delayed closing movement of a valve, temperature and viscosity variations of an associated fluid, such as, for example, engine oil, may result in an inconsistency in the timing of the closing of the engine valve. FIG. 3 generally illustrates a seating variation (shown generally by segment 403).

Accordingly, a need exists to provide an added motion system that can provide controlled engine valve seating and controlled added motion closing movement to a valve over a wide range of fluid temperatures and/or viscosities.

BRIEF DESCRIPTION OF THE DRAWINGS

Embodiments of the disclosure will now be described, by way of example, with reference to the accompanying exemplary drawings, wherein.

DETAILED DESCRIPTION

Figure 1:
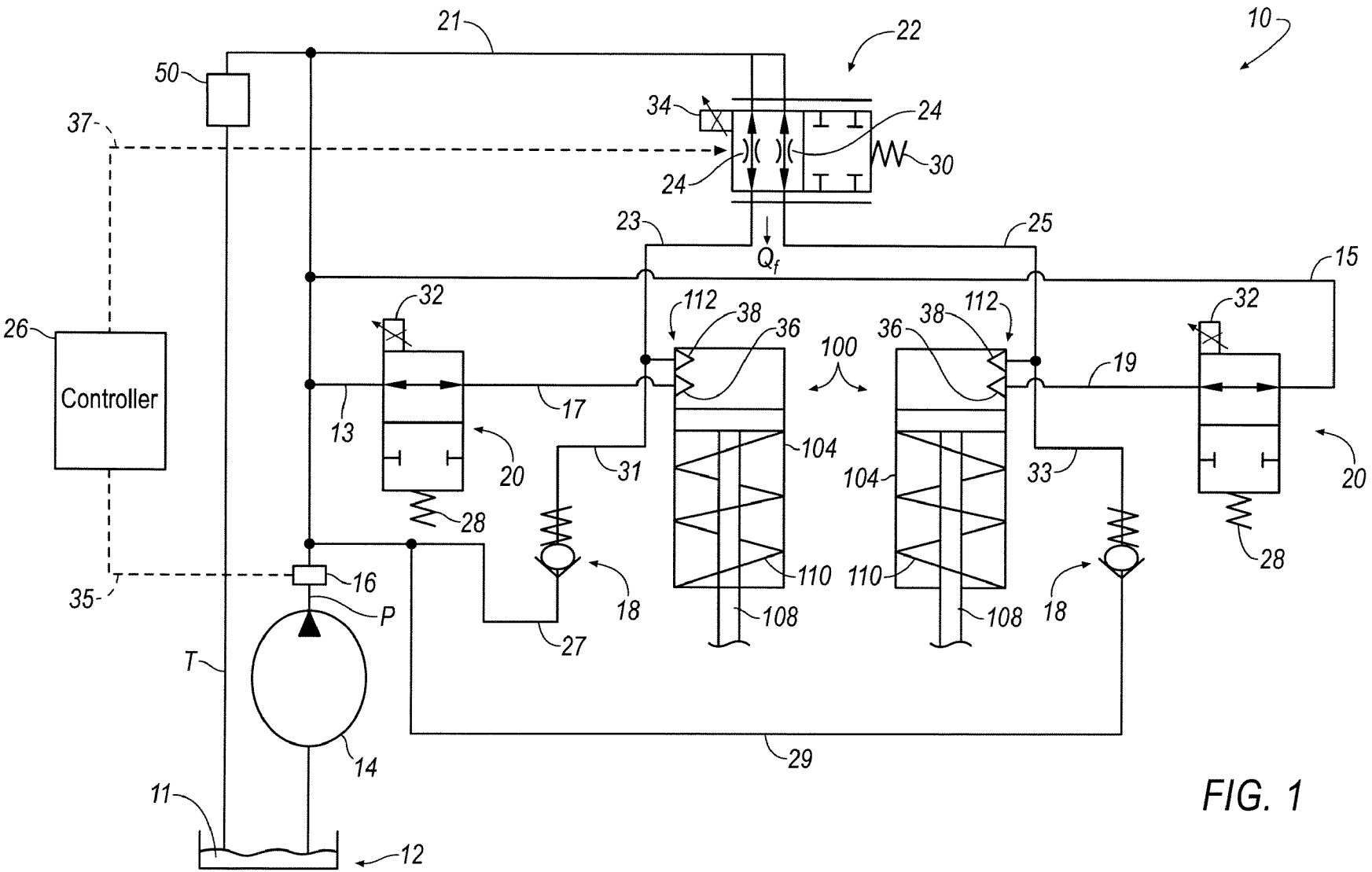
FIG. 1 is a schematic of a system for operating one or more added motion valves according to an embodiment of the present invention.

FIG. 1 generally illustrates an embodiment of the invention with a hydraulic circuit 10 in fluid communication with a plurality of added motion valve systems 100. The hydraulic circuit 10 includes a sump 12 associated with fluid 11; a pump 14; a fluid temperature sensor 16; one or more check valves 18; one or more main valves 20; a proportional valve 22 including valve flow orifices 24; and a controller 26. The main valve 20 and proportional valve 22 may comprise a solenoid valve and, in the illustrated embodiment, such valves are shown including springs 28, 30 and single solenoids 32, 34. While the valves 20, 22 are shown as spring-offset single-solenoid valves, it will be appreciated that the valves 20, 22 may take on other desirable valve configurations. For example, the valves 20, 22 may instead comprise a dual-solenoid having any desirable fluid flow path, such as, for example, a single flow path or a parallel flow path. A pressure regulator is shown generally at 50. The pressure regulator 50 controls the pressure of the fluid 11 to the circuit 10 as provided by the pump 14.

Figure 2:
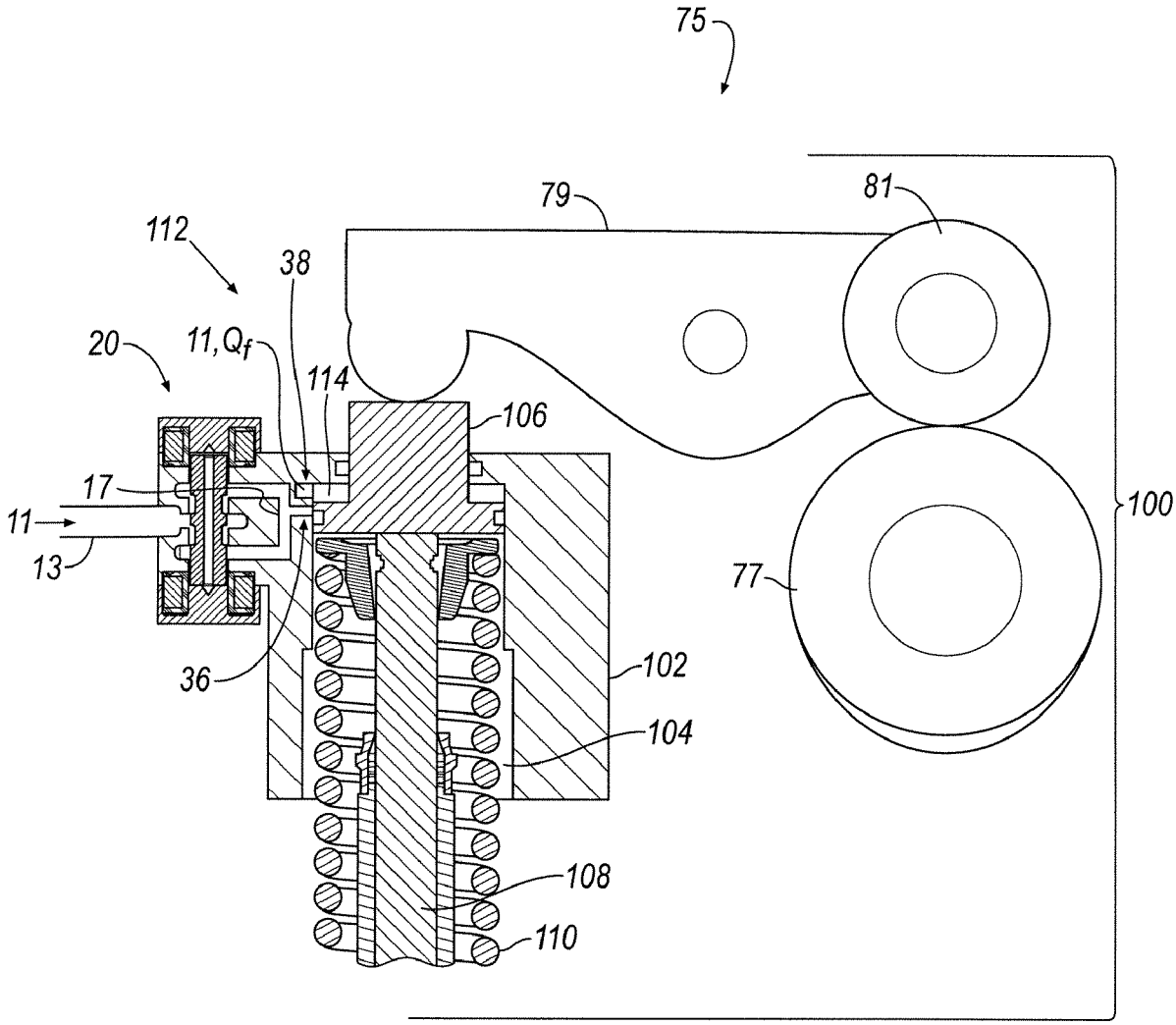
FIG. 2 is a representative diagram of an added motion valve system according to an embodiment of the present invention.

An embodiment of an added motion valve system 100, including a cam system 75, is generally illustrated in FIG. 2. The illustrated cam system 75 generally includes a camshaft 77, rocker arm 79, and rocker arm roller 81. The valve system 100 is generally shown to include, among other things, an added motion valve body 102 having a bore 104; a piston 106; an engine valve 108; an engine valve spring 110; and an actuator 112, which is generally defined by a first port 36, a second port 38, the valve body 102, and piston 106. The actuator 112 permits movement of fluid 11 from the valves 20, 22 of the hydraulic circuit 10 (FIG. 1) to an actuator fluid volume 114 of the bore 104.

Referring to FIG. 1, the proportional valve 22 may be controlled by applying current to an associated solenoid 34. If the current is less than the amount of current needed to operate the solenoid 34, the current may be amplified by an amplifier card (not shown). If included, such an amplifier card can be mounted on, or, instead may be located remotely from the proportional valve 22. As current flows through a coil (not shown), an electromotive force is developed, causing an associated armature or push pin (not shown) to move, which, in turn, inputs a force to a valve spool (not shown), thereby causing the valve spool to travel. With such a configuration, the valve spool will typically continue in motion until the solenoid force is balanced by a return spring force. Accordingly, valve spool travel can be made relative (i.e., proportional) to the amount of current passing through the coil of the solenoid 34.

Referring to FIGS. 1 and 2, the operation of an added motion valve systems 100 is discussed in connection with a hydraulic circuit 10. In operation, the valves 20, 22 of the hydraulic circuit 10 can improve operation of the added motion valve system 100 over a wide range of temperatures/viscosities associated with fluid 11. In the illustrated embodiment, fluid 11 is fed by pump 14 to valves 18, 20, and 22 when the valve system 100 is opened. When the valve system 100 is closed, fluid 11 is returned to sump 12. For purposes of simplicity, the fluid feed line is generally shown designated as P and the fluid return line is generally shown designated as T.

In FIG. 1, the temperature of fluid 11 from a pump 14 is sensed by a fluid temperature sensor 16. The fluid 11 is delivered to a main valve 20 over a fluid passage 13, 15. The main valve 20 feeds fluid 11 to a first port 36 through a fluid passage 17, 19. The temperature of fluid 11 from the pump 14 is sensed by fluid temperature sensor 16. The fluid is then passed to a proportional valve 22 over a fluid passage 21. The proportional valve 22 feeds fluid 11 to a second port 38 through a fluid passage 23, 25. Fluid 11 from the pump 14 is also sensed by the fluid temperature sensor 16 as it passes to a check valve 18 over a fluid passage 27, 29. The check valve 18 feeds fluid 11 to the second port 38 through a fluid passage 31, 33.

According to an embodiment, the proportional valve 22 serves as a seating valve for seating an engine valve 108 when fluid 11 is being pumped out of actuator volume 114 at a second port 38. The check valves 18 can feed fluid 11 to the second port 38 when the main valve 20 is in a closed position. Accordingly, the primary purpose of the check valves 18 is to more easily fill the actuator volume 114, especially at low engine operating temperatures. Thus, in operation, the first port 36 is closed off when an engine valve 108 is in the closed position or when the engine valve is seated as the second port 38 is always exposed to the actuator volume 114.

In such an arrangement, when the proportional valve 22 seats the engine valve 108, the proportional valve 22 may function as a slow speed valve (i.e., the valve 22 doesn't have to respond for every cycle of the cam mechanism), for example, one having a 10-to-20 milli-second closing rate. If desired, a valve flow orifice 24 may be adjusted to compensate, at least in part, for different oil viscosities resulting from different fluid operating temperatures to provide more consistent seating 303 and delayed movement/locking 401 of an engine valve 108. For example, in Winter, a vehicle may be called upon to start when the ambient temperature is −40° F. Accordingly, the fluid temperature sensor 16 may detect the operating temperature of the fluid 11 from the pump 14, which is then provided to the controller 26 (e.g., over communication line 35). For instance, the controller 26 can then provide a signal to the proportional valve 22 over communication line 37 to increase the opening of the orifice 24 to compensate for a decreased flow rate quantity $Q_f$ of fluid 11 (i.e., due to low fluid viscosity) from a second port 38. As the temperature of fluid 11 rises (i.e., as the viscosity of the fluid 11 rises), the temperature sensor 16 provides a temperature signal to the controller 26 (e.g., over communication line 35) so that the controller 26 may command the proportional valve 22 (over line 37) to decrease the opening of the orifice 24 to, at least in part, compensate for a increased flow rate quantity $Q_f$ of fluid 11 from a second port 38. Accordingly, the temperature sensor 16 can function as a feedback link in a closed-loop control system for controlling the fluid 11 delivered to the valve system 100 in view of changes in operation temperature/viscosity associated with fluid 11.

The main valve 20 can be designed as a high speed valve (i.e., the valve 20 may have to operate for every cycle of the cam mechanism) that may default to an open state, but, given a directional control of fluid from the check valve 18, main valve 20 may be closed during or prior to an engine valve 108 opening stroke. The open state of the main valve 20 can, among other things, provide a fail-safe feature to the operation of the valve system 100. If the main valve 20 is moved from an open state to a closed state, the movement to the closed state can be accomplished gradually (e.g., to one having a closing rate of 10-to-15 milli-seconds), and, when the valve is returned to the open state, the opening rate can be sped up (e.g., to a time of 1-to-2 milli-seconds).

Figure 3:
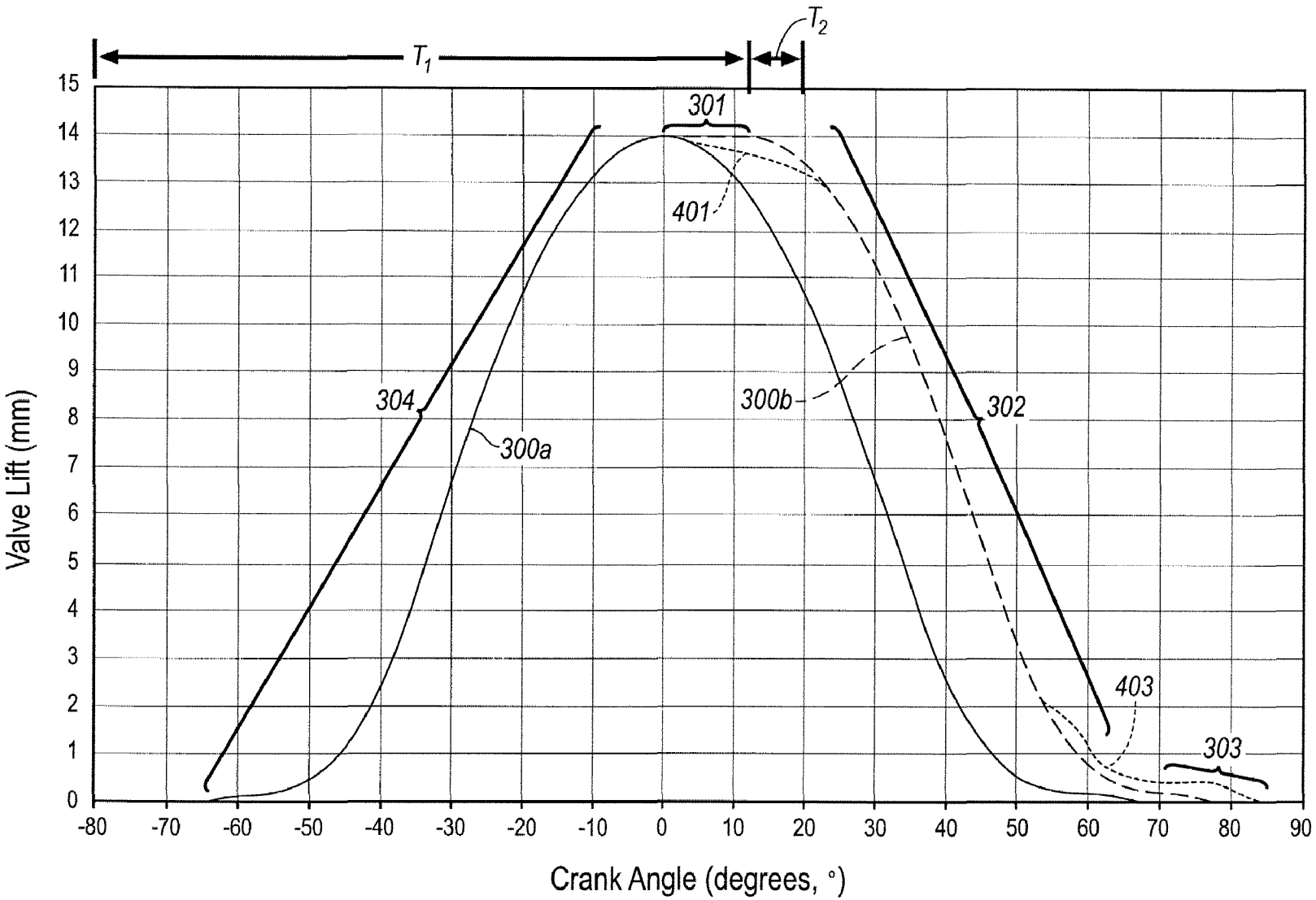
FIG. 3 is a graph that generally illustrates a cam valve lift timing profile and an added motion valve lift timing profile according to an embodiment of the present invention.

An added-motion engine valve opening/closing curve **300*b* according to an embodiment is shown generally as 300*b* in FIG. 3. A main valve 20 is primarily responsible for the control of the flow of fluid 11 from one or more actuators 112 for delaying the closing movement of one or more associated engine valves (e.g., as shown generally at segment 301 of the added-motion curve 300*b*). A proportional valve 22 is primarily responsible for the control of the flow of fluid 11 from one or more actuators 112 for seating an engine valve (e.g., as shown generally at segment 303) during the closing movement of such valve. The main valve 20, as explained above, may be closed (at any time during the time period generally designated as $T_1$) but can be configured to open quickly (at any time during the time period generally designated as $T_2$) to provide a controlled location for a closing movement associated with an engine valve (e.g., which is shown generally designated as segment 302). If a main valve 20 is closed during the opening movement of an associated engine valve, which is shown generally designated as segment 304, the check valve can then provide flow of fluid 11 to second port 38**.

Accordingly, because the temperature may affect the viscosity of the fluid 11, a valve flow orifice 24 of a proportional valve 22 may be varied accordingly in view of the sensed operating temperature of the fluid 11 detected by a temperature sensor 16. As such, variations of the viscosity of the fluid 11 that could result in an inconsistency of the seating 403 and/or an inconsistency with a delayed closing movement 401 of an engine valve can be reduced or eliminated.

The present invention has been particularly shown and described with reference to the foregoing embodiments, which are merely illustrative of the best mode or modes for carrying out the invention. It should be understood by those skilled in the art that various alternatives to the embodiments of the invention described herein may be employed in practicing the invention without departing from the spirit and scope of the invention as defined in the following claims. It is intended that the following claims define the scope of the invention and that the method and apparatus within the scope of these claims and their equivalents be covered thereby. This description of the invention should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

What is claimed is:

1. A hydraulic circuit, comprising:

an added motion valve system including a piston, an actuator body having a bore, wherein the piston is disposed within the bore of the actuator body, wherein a portion of the bore includes an actuator volume formed by the piston and the actuator body, wherein the actuator body forms a first fluid port and a second fluid port that are in fluid communication with the actuator volume;

a first solenoid valve in fluid communication with the actuator volume by way of the first fluid port;

a second solenoid valve in fluid communication with the actuator volume by way of the second fluid port, wherein the second solenoid valve includes a proportional valve that provides means for introducing consistency to a delayed closing movement of an engine valve, and a seating movement of the engine valve, wherein the introduced consistency is provided by always exposing fluid communication to the actuator volume by way of the second port and by adjusting an opening provided by a valve flow orifice of the proportional valve to compensate for different viscosities of the fluid in relation to the operating temperature of the fluid as the fluid is pumped from the actuator volume by way of the second port;

a temperature sensor coupled to a controller, wherein the controller is coupled to the second solenoid valve, wherein the temperature sensor and controller provides means for detecting an operating temperature of fluid in the hydraulic circuit for adjusting a flow rate quantity of fluid into the actuator fluid volume as a function of the operating temperature of the fluid.

2. The hydraulic circuit according to claim 1, wherein the adjusting of the opening of the valve flow orifice includes increasing the opening of the valve flow orifice to compensate for a decreased flow rate quantity of the fluid from the actuator volume, and decreasing the opening of the valve flow orifice to compensate for increased flow rate quantity of the fluid from the actuator volume.

3. The hydraulic circuit according to claim 1, wherein the engine valve is disposed within the bore.

4. The hydraulic circuit according to claim 1, wherein the first solenoid valve is a main valve that provides means for delaying the closing movement of the engine valve as the engine valve transitions from opening movement to closing movement.

5. The hydraulic circuit according to claim 4, wherein the main valve is moveable to be in one of a closed orientation and an opened orientation, wherein the closed orientation is permitted to occur during the opening movement and during a delayed closing period of the engine valve, wherein the opened orientation is permitted to occur during the delayed closing period and during the closing movement of the engine valve.

6. The hydraulic circuit according to claim 5, wherein the main valve is a high speed valve that having a default orientation, wherein the default orientation is the opened orientation.

7. The hydraulic circuit according to claim 5 further comprising a check valve in fluid communication with the proportional valve, wherein the check valve provides means for providing fluid flow of the fluid to the actuator volume by way of the second fluid port if the main valve is moved to the closed orientation.

8. A method for controlling a hydraulic circuit, comprising the steps of:

providing fluid communication with an actuator volume of an actuator body of an added motion valve system by way of a first fluid port that is in fluid communication with a first solenoid valve that permits fluid communication with the actuator volume by way of the first fluid port when the first solenoid valve is moved to an opened orientation and denies fluid communication with the actuator volume by way of the first fluid port when the first solenoid valve is moved to a closed orientation;

providing fluid communication with the actuator volume of the actuator body of the added motion valve system by way of a second fluid port that is in fluid communication with a second solenoid valve that always provides fluid communication with the actuator volume by way of the second fluid port;

detecting an operating temperature of the fluid in the hydraulic circuit; and adjusting a flow rate quantity of the fluid from the actuator volume of the added motion valve system by controlling an opening provided by a valve flow orifice of the second solenoid valve to compensate for different viscosities of the fluid, wherein the controlling of the opening is conducted as a function of the detected operating temperature of the fluid.

9. The method according to claim 8, wherein the controlling of the opening of the valve flow orifice permits controlling a consistency of a seating of an engine valve of the added motion valve system based upon the adjusted flow rate quantity of the fluid from the actuator volume.

10. The method according to claim 8 further comprising the step of utilizing the first solenoid valve for delaying closing movement of the engine valve as the engine valve transitions from an opening movement to a closing movement.

11. The method according to claim 8 further comprising the step of:

permitting fluid communication with the actuator volume by way of a check valve at the second fluid port when the first solenoid valve is moved to the closed orientation.

* * * * *